US009157427B2

(12) United States Patent
Kurita et al.

(10) Patent No.: US 9,157,427 B2
(45) Date of Patent: Oct. 13, 2015

(54) COMPRESSOR

(71) Applicants: KABUSHIKI KAISHA TOYOTA JIDOSHOKKI, Aichi-ken (JP); TOKYU CO., LTD., Aichi-ken (JP)

(72) Inventors: Hajime Kurita, Kariya (JP); Masakazu Obayashi, Kariya (JP); Yasushi Suzuki, Kariya (JP); Yoshio Kimoto, Kariya (JP); Masakazu Hashimoto, Aichi-ken (JP); Takayuki Inoue, Aichi-ken (JP); Katsuji Abe, Aichi-ken (JP); Fumitaka Yoshizumi, Nisshin (JP); Masakatsu Kuroishi, Seto (JP); Yasuhiro Kondoh, Nisshin (JP); Kazunori Yoshida, Nagoya (JP)

(73) Assignees: KABUSHIKI KAISHA TOYOTA JIDOSHOKKI, Aichi-Ken (JP); TOKYU CO., LTD., Aichi-Ken (JP)

( * ) Notice: Subject to any disclaimer, the term of this patent is extended or adjusted under 35 U.S.C. 154(b) by 329 days.

(21) Appl. No.: 13/675,390

(22) Filed: Nov. 13, 2012

(65) Prior Publication Data

US 2013/0129546 A1 May 23, 2013

(30) Foreign Application Priority Data

Nov. 17, 2011 (JP) ..... 2011-251259

(51) Int. Cl.

| | |
|---|---|
| ***F04B 39/10*** | (2006.01) |
| ***F04B 27/10*** | (2006.01) |
| ***F04B 53/10*** | (2006.01) |

(52) U.S. Cl.

CPC ..... *F04B 39/1073* (2013.01); *F04B 27/1009* (2013.01); *F04B 39/1066* (2013.01)

(58) Field of Classification Search

CPC ..... F04B 27/1009; F04B 53/1037; F04B 53/1047; F04B 53/106; F04B 39/1073; F04B 39/1066; F16K 15/16; F16K 15/14; F16K 27/0209

See application file for complete search history.

(56) References Cited

U.S. PATENT DOCUMENTS 5,722,818 A 3/1998 Ohta et al.
5,839,472 A * 11/1998 Shintoku et al. ..... 137/856

(Continued)

FOREIGN PATENT DOCUMENTS

CN 1093917 11/2002
EP 0962655 12/1999

(Continued)

OTHER PUBLICATIONS

Korean Office action, mail date is Jan. 27, 2014.

(Continued)

*Primary Examiner* — Bryan Lettman
(74) *Attorney, Agent, or Firm* — Greenblum & Bernstein, P.L.C.

(57) ABSTRACT

A compressor includes a valve base plate, which is arranged between a suction chamber and a compression chamber and has a suction port. The valve base plate includes a sealing surface, a recessed groove, a receiving surface, and a support surface. The sealing surface is flush with a fixing surface and contacts the valve portion in an annular manner. The recessed groove is located at an outer side of the sealing surface and recessed with respect to the fixing surface. The recessed groove includes a bottom portion and separates an edge portion of the valve portion from the bottom portion. The receiving surface is flush with the fixing surface and capable of contacting a distal zone of the valve portion. The support surface is flush with the fixing surface and capable of contacting a middle zone located at an inner side of the sealing surface of the valve portion.

7 Claims, 12 Drawing Sheets

(56) References Cited

U.S. PATENT DOCUMENTS

| | | | | |
|---|---|---|---|---|
| 7,004,734 | B2 * | 2/2006 | Izawa et al. | 417/569 |
| 2006/0280617 | A1 | 12/2006 | Uehara et al. | |
| 2012/0301341 | A1 | 11/2012 | Ota et al. | |
| 2013/0052066 | A1 * | 2/2013 | Moroi et al. | 417/559 |

FOREIGN PATENT DOCUMENTS

| | | | | |
|---|---|---|---|---|
| JP | 8-28449 | | 1/1996 | |
| JP | 2006-226113 | | 8/2006 | |
| JP | 2009-235913 | | 10/2009 | |
| JP | 2011-226471 | | 11/2011 | |
| JP | 2011226471 | * | 11/2011 | F04B 39/10 |
| KR | 1020060096003 | | 9/2006 | |
| WO | 2004/106740 | | 12/2004 | |
| WO | 2011093320 | | 8/2011 | |

OTHER PUBLICATIONS

Chinese Official Action for CN Appl. No. 201210455187.5 dated Dec. 3, 2014, along with an English-language translation thereof.

U.S. Appl. No. 13/625,499 to Hajime Kurita et al., filed Sep. 24, 2012.

* cited by examiner

COMPRESSOR

BACKGROUND OF THE INVENTION

The present invention relates to a compressor.

A compressor disclosed in Japanese Laid-Open Patent Publication No. 2009-235913 is publicly known. The compressor has a valve base plate arranged between a suction chamber and a compression chamber. The valve base plate has a suction port, which extends through the valve base plate and allows communication between the suction chamber and the compression chamber. The suction port is selectively opened and closed by a suction reed valve, which is arranged in the suction chamber.

The suction reed valve is elastically deformable and formed using a plate material having front and back surfaces, which extend parallel to each other when in a normal state. The suction reed valve has a fixing portion fixed to the valve base plate, a base portion that extends longitudinally from the fixing portion and can be lifted from the valve base plate, and a valve portion that extends from the base portion toward the distal longitudinal end to selectively open and close the suction port.

The valve base plate is arranged in the suction chamber and has a fixing surface. The fixing portion is fixed to the fixing surface through contact between a back surface of the fixing portion and the fixing surface. The valve base plate includes a sealing surface, which is flush with the fixing surface and capable of contacting a back surface of the valve portion in an annular manner at a position around the suction port. The valve base plate also has an annular groove, which is located on the outer side of the sealing surface in a manner recessed with respect to the fixing surface and arranged around the full circumference of the suction port.

In this type of compressor, as the deformation amount, which is the lift amount, of the suction reed valve at the time of suction becomes smaller, the resistance between the reed valve and the valve base plate becomes greater. This hampers smooth gas flow, thus causing power loss.

To conserve energy, the conventional compressor is demanded to promote suppression of such power loss.

Also, to prevent damage to the suction reed valve, the durability of the compressor is demanded to improve.

SUMMARY OF THE INVENTION

Accordingly, it is an objective of the present invention to provide a compressor that promotes power loss suppression and durability improvement.

To achieve the above-described objective, the inventors of the present invention analyzed details of the conventional compressor. As a result of the analysis, they focused attention on thinning of the suction reed valve and the instant at which the suction reed valve closes.

Specifically, a thin suction reed valve is easily flexed and thus allows a smooth gas flow between the reed valve and the valve base plate. This prevents resistance from occurring in the gas flow, thus decreasing the power loss.

However, if the conventional compressor has such a thin suction reed valve, a distal zone of the valve portion flexes and sinks deeply into the recessed groove at the instant the suction reed valve closes. In this case, a middle zone of the valve portion also flexes and sinks deeply into the suction port due to inertial force or the pressure difference between the compression chamber and the suction chamber in a compression stroke. This may cause fatigue fracture in the valve portion, particularly when the compressor operates at high speed. In this case, the durability of the compressor is reduced.

To solve these problems, the inventors accomplished the present invention.

In accordance with one aspect of the present invention, a compressor that includes a valve base plate and a suction reed valve is provided. The valve base plate is arranged between a suction chamber and a compression chamber. The valve base plate includes a suction port for permitting communication between the suction chamber and the compression chamber. The suction reed valve selectively opens and closes the suction port. The suction reed valve is elastically deformable and has an elongated shape having a distal end. The suction reed valve includes a fixing portion fixed to the valve base plate, a base portion that extends from the fixing portion in a longitudinal direction of the suction reed valve and selectively contacts and separates from the valve base plate, and a valve portion that extends from the base portion longitudinally toward the distal end and selectively opens and closes the suction port. The valve base plate has a fixing surface formed at a side facing the compression chamber. The fixing portion of the suction reed valve is held in contact with and fixed to the fixing surface. The valve portion includes a distal zone including an edge portion at the distal end. The valve base plate includes a sealing surface flush with the fixing surface, a recessed groove, a receiving surface flush with the fixing surface, and a support surface flush with the fixing surface. The sealing surface is capable of contacting the valve portion in an annular manner around the suction port. The recessed groove is located on an outer side of the sealing surface and recessed with respect to the fixing surface. The recessed groove includes a bottom portion. The recessed groove separates the edge portion of the valve portion from the bottom portion. The receiving surface is capable of contacting the distal zone of the valve portion. The support surface is capable of contacting a middle zone located on an inner side of the sealing surface of the valve portion.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A compressor according to first to ninth embodiments of the present invention will now be described with reference to the attached drawings.

First Embodiment

Figure 1:
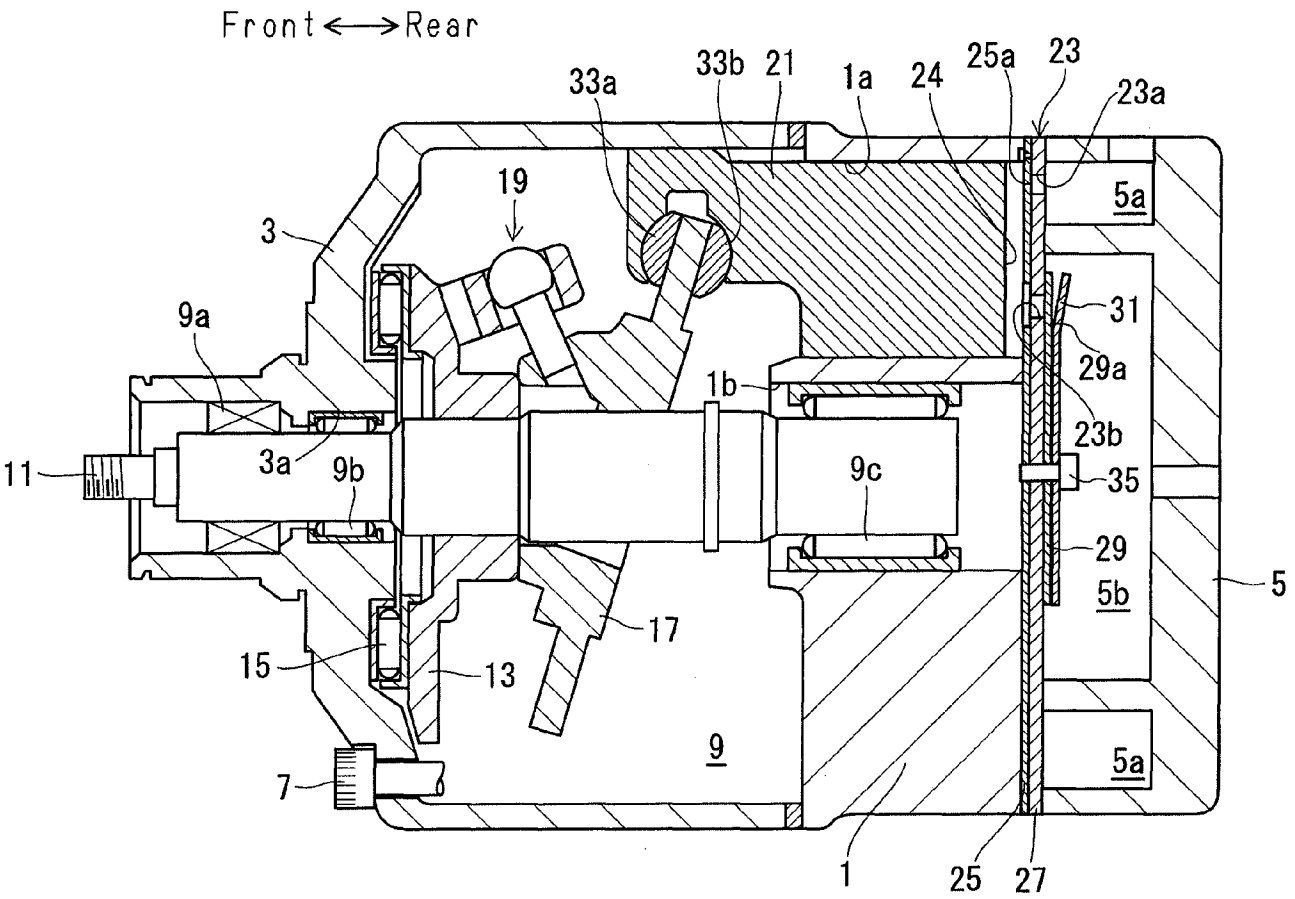
FIG. 1 is a cross-sectional view showing a compressor according to first to ninth embodiments of the present invention.

A compressor according to a first embodiment of the present invention is a swash plate type variable displacement compressor. As shown in FIG. 1, the compressor includes a plurality of cylinder bores 1*a*, which are formed in a cylinder block 1 and spaced apart at equal angular intervals along a circle. The cylinder bores 1*a* are parallel to one another. The cylinder block 1 is arranged between a front housing member 3, which is located in front, and a rear housing member 5, which is located behind. In this state, the cylinder block 1, the front housing member 3, and the rear housing member 5 are fastened together using a plurality of bolts 7. The cylinder block 1 and the front housing member 3 form a crank chamber 9 in the cylinder block 1 and the front housing member 3. In the rear housing member 5, a suction chamber 5*a* and a plurality of discharge chambers 5*b* corresponding to the cylinder bores 1*a* are formed.

The front housing member 3 has a shaft hole 3*a* and the cylinder block 1 has a shaft hole 1*b*. A drive shaft 11 is rotationally supported in the shaft holes 3*a*, 1*b* through a shaft sealing device 9*a* and corresponding radial bearings 9*b*, 9*c*. The drive shaft 11 has a non-illustrated pulley or electromagnetic clutch. A non-illustrated belt is wound around the pulley or a pulley of the electromagnetic clutch and driven by the engine of the vehicle.

In the crank chamber 9, a lug plate 13 is press-fitted around the drive shaft 11. A thrust bearing 15 is provided between the lug plate 13 and the front housing member 3. A swash plate 17 is arranged around the drive shaft 11. The drive shaft 11 extends through the swash plate 17. The lug plate 13 and the swash plate 17 are connected to each other through a link mechanism 19, which supports the swash plate 17 such that the inclination angle of the swash plate 17 is changeable.

A piston 21 is reciprocally accommodated in each of the cylinder bores 1*a*. A valve unit 23 is arranged between the cylinder block 1 and the rear housing member 5. The valve unit 23 of the compressor includes a suction valve plate 25 contacting the rear end surface of the cylinder block 1, a valve base plate 27 contacting the suction valve plate 25, a discharge valve plate 29 contacting the valve base plate 27, and a retainer plate 31 contacting the discharge valve plate 29. The suction valve plate 25 and the valve base plate 27 will be described in detail below.

A pair of front and rear shoes 33*a*, 33*b* is located between the swash plate 17 and each of the pistons 21. Each of the pairs of shoes 33*a*, 33*b* converts swinging of the swash plate 17 into reciprocation of the associated one of the pistons 21.

The crank chamber 9 and the suction chamber 5*a* are connected to each other via a non-illustrated air bleed passage. The crank chamber 9 and a discharge chamber 5*b* are connected to each other via a non-illustrated air supply passage. A non-illustrated displacement control valve is located in the air supply passage. The displacement control valve changes the opening of the air supply passage in correspondence with the suction pressure. Each of the cylinder bores 1*a*, the associated one of the pistons 21, and the valve unit 23 form a compression chamber 24. A condenser is connected to the discharge chamber 5*b* of the compressor through a pipe. An evaporator is connected to the condenser via an expansion valve through a pipe. The evaporator is connected to the suction chamber 5*a* of the compressor through a pipe.

Figure 2:
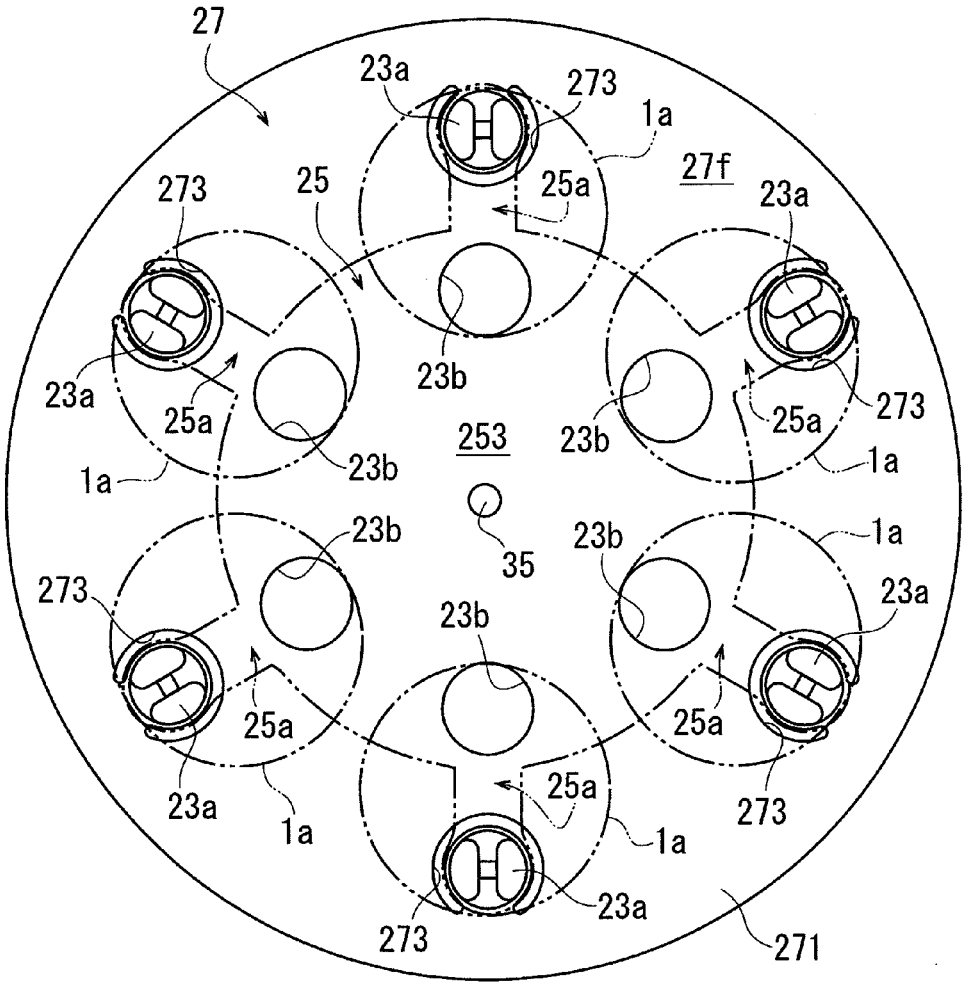
FIG. 2 is a plan view showing a valve base plate of the compressor according to the first embodiment.
Figure 3A:
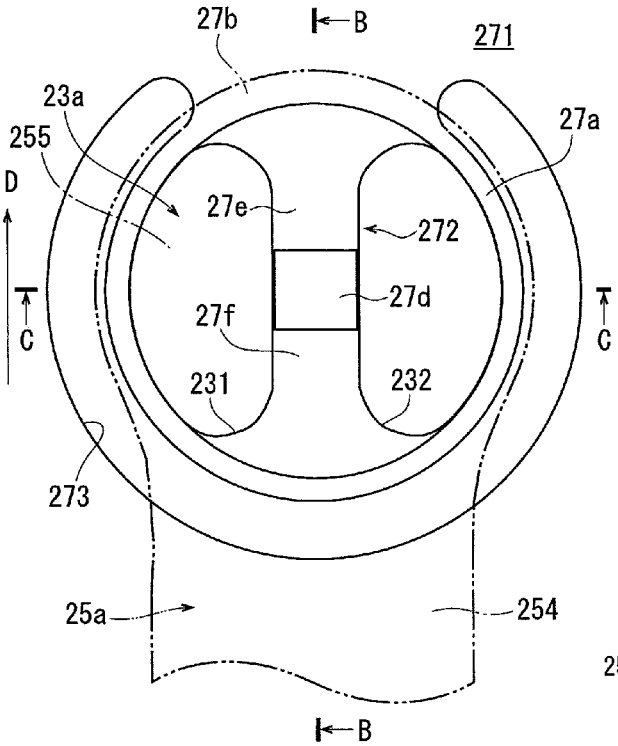
FIG. 3A is an enlarged partial plan view of the valve base plate in the compressor of the first embodiment, showing the vicinity of a suction port.
Figure 3B:
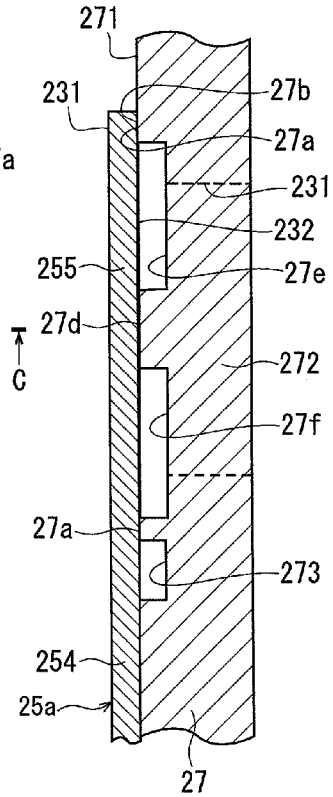
FIG. 3B is a cross-sectional view taken along line B-B of FIG. 3A.
Figure 3C:
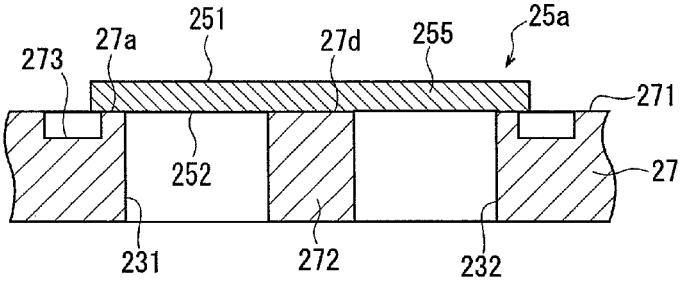
FIG. 3C is a cross-sectional view taken along line C-C of FIG. 3A.

A plurality of suction ports 23*a* are each formed in the valve base plate 27 to allow communication between the suction chamber 5*a* and the corresponding one of the compression chambers 24. In the first embodiment, a suction valve plate 25 is punched out of a plate material formed of spring steel through press working. As shown in FIG. 2, the suction valve plate 25 includes a plurality of suction reed valves 25*a*, each of which extends radially to selectively open and close the corresponding one of the suction ports 23*a*. With reference to FIGS. 3B and 3C, each of the suction reed valves 25*a* is elastically deformable and formed by a plate material having a front surface 251 and a back surface 252, which are parallel to each other when in a normal state.

As illustrated in FIG. 1, a plurality of discharge ports 23*b* are formed in the suction valve plate 25 and the valve base plate 27 to allow communication between the corresponding compression chambers 24 and the discharge chamber 5*b*. A plurality of discharge reed valves 29*a* are formed in the discharge valve plate 29 to selectively open and close the corresponding discharge ports 23*b*.

Each of the suction reed valves 25*a* has an elongated shape having a distal end and includes a fixing portion 253, a base portion 254, and a valve portion 255. Referring to FIGS. 1 and 2, the fixing portion 253 is arranged at the center of the suction valve plate 25 and fixed to the valve base plate 27 through a bolt 35. As shown in FIG. 3A, the base portion 254 extends from the fixing portion 253 in the longitudinal direction D, which is a radial direction, and can be lifted from the valve base plate 27. The valve portion 255 extends from the base portion 254 to the distal end in the longitudinal direction D to selectively open and close the corresponding suction port 23*a*. In the first embodiment, the base portion 254 is formed in a rectangular shape having a long side extending in the longitudinal direction D. The valve portion 255 is formed in a circular shape having a diameter not less than the length of the short side of the base portion 254. This configuration allows each suction reed valve 25*a* to open the corresponding suction port 23*a* by a great opening degree.

Figure 4:
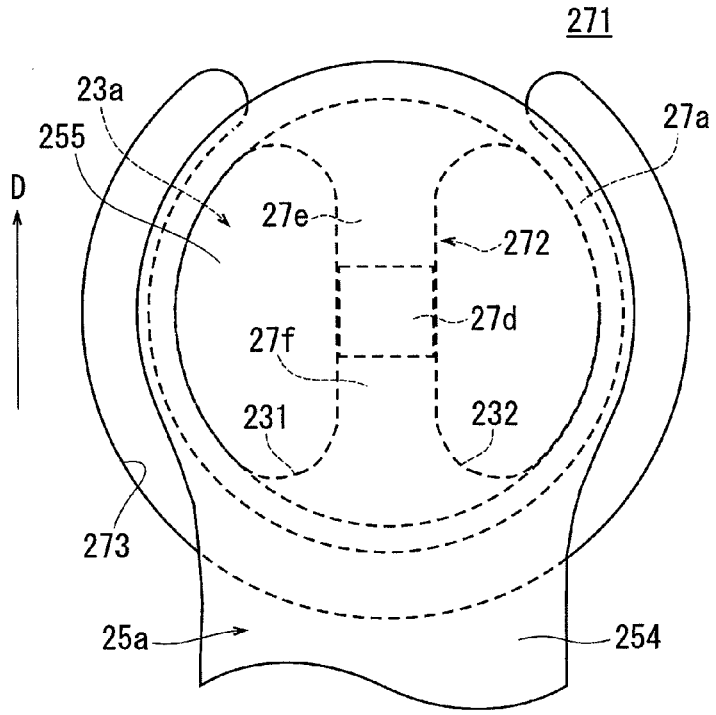
FIG. 4 is an enlarged partial plan view of the compressor according to the first embodiment, showing the valve base plate and a suction reed valve.

As illustrated in FIGS. 3B, 3C, and 4, the valve base plate 27 has a fixing surface 271. The fixing portion 253 is fixed to the fixing surface 271 with a back surface 252 held in contact with the fixing surface 271. The fixing surface 271 is located on the side of the valve base plate 27 that faces the compression chamber 24. The valve base plate 27 includes extended portions 272, each of which extends in the longitudinal direction D. Each extended portion 272 divides the corresponding suction port 23*a* into two, left and right, port sections in the direction perpendicular to the longitudinal direction D. Specifically, each suction port 23*a* is divided into semi-circular port sections 231, 232 by the corresponding extended portion 272. When the valve base plate 27 is viewed from above, each suction port 23*a* has a circular shape, as a whole, formed by the port sections 231, 232.

Figure 5:
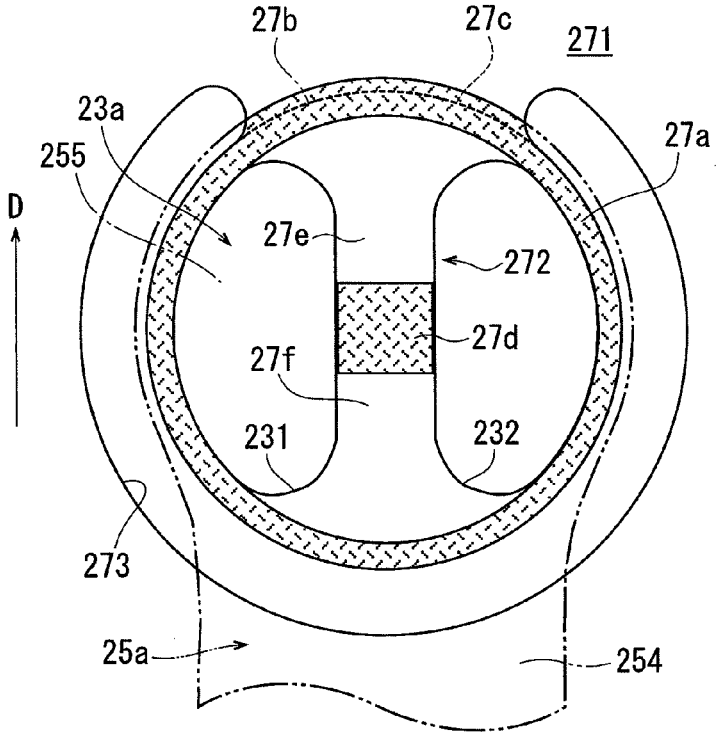
FIG. 5 is an enlarged partial plan view of the compressor according to the first embodiment, showing the valve base plate.

Recessed grooves 273, each of which has a C shape and is discontinuous at the distal end in the longitudinal direction D, are formed in the valve base plate 27 and are recessed with respect to the fixing surface 271. With reference to FIG. 5, an annular sealing surface 27*a* is formed between each suction port 23*a* and the corresponding recessed grooves 273 in the valve base plate 27. Each of the sealing surfaces 27*a* is flush with the fixing surface 271. The sealing surface 27*a* is allowed to contact the back surface 252 of the valve portion 255 in an annular manner around the corresponding suction port 23*a*. Each recessed groove 273 is located on the outer side of the corresponding sealing surface 27*a* and recessed with respect to the fixing surface 271 such that opposite edge portions of the valve portion 255 and the base portion 254 are spaced from the bottom portion of the recessed groove 273.

In the valve base plate 27, each recessed groove 273 has a C shape and is discontinuous at the distal end in the longitudinal direction D. As a result, a receiving surface 27*b* is formed at the position at which the opposite ends of each recessed groove 273 are spaced from each other, or the position between the opposite ends of the recessed groove 273. Each of the receiving surfaces 27*b* is flush with the fixing surface 271. Each receiving surface 27*b* is allowed to contact the back surface 252 in a distal zone of the corresponding valve portion 255. The distal zone of each valve portion 255 is located longitudinally distal with respect to the portion at which the back surface of the valve portion 255 contacts the sealing surface 27*a* of the valve base plate 27 and includes a portion of the edge portion of the valve portion 255. Referring to FIG. 5, the sealing surface 27*a* and the receiving surface 27*b* contact the back surface 252 of the valve portion 255 as indicated by the corresponding hatched area. An arc 27*c* in the hatched area represents the boundary between the sealing surface 27*a* and the receiving surface 27*b*. The sealing surface 27*a* and the receiving surface 27*b* are formed continuously from each other.

A support surface 27*d* is formed at the center of a surface of the extended portion 272 that faces the corresponding valve portion 255. The support surfaces 27*d* are flush with the fixing surface 271. Each of the support surfaces 27*d* is allowed to contact the back surface 252 at the position corresponding to a middle zone of the corresponding one of the valve portions 255. The middle zone of each valve portion 255 is a portion of the valve portion 255 located inward of the portion of the valve portion 255 at which the back side of the valve portion 255 contacts the sealing surface 27*a* of the valve base plate 27. The middle zone of the valve portion 255 includes a central zone corresponding to a central portion of the valve portion 255. A communication groove 27*e* and a communication groove 27*f* are formed in the extended portion 272 on the front side and the back side, respectively, of each support surface 27*d*. The communication grooves 27*e*, 27*f* are recessed with respect to the fixing surface 271. Accordingly, when each valve portion 255 closes, the corresponding communication grooves 27*e*, 27*f* allows communication between the port sections 231, 232. Referring to FIG. 5, the support surface 27*d* contacts the back surface 252 of the valve portion 255 as indicated by the corresponding hatched area.

Figure 6:
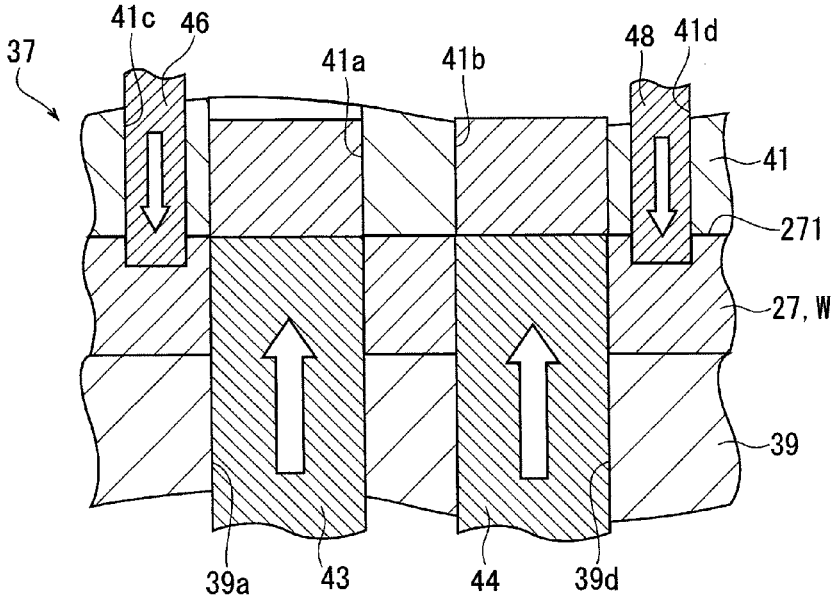
FIG. 6 is a schematic cross-sectional view of the compressor according to the first embodiment, showing a manufacturing step of the valve base plate.

The valve base plate 27, which has the above-described configuration, is molded using a die 37 shown in FIG. 6. The die 37 has a lower die portion 39 and an upper die portion 41. A workpiece W, from which the valve base plate 27 is to be formed, is clamped between the lower die portion 39 and the upper die portion 41. Punch holes 39*a*, 39*d* are formed in the lower die portion 39 at positions corresponding to the port sections 231, 232 and extend through the lower die portion 39 in the vertical direction. Punches 43, 44 are each received in the corresponding punch holes 39*a*, 39*d* movably in the vertical direction.

Outlet holes 41*a*, 41*b* corresponding to the punch holes 39*a*, 39*d* are formed in the upper die portion 41 and extend through the upper die portion 41 in the vertical direction. Punch holes 41*c*, 41*d* are formed in the upper die portion 41 at positions corresponding to the grooves 273 and the communication grooves 27*e*, 27*f* and extend through the upper die portion 41 in the vertical direction. Punches 46, 48 are received in the corresponding punch holes 41*c*, 41*d* movably in the vertical direction.

To form the valve base plate 27 from the workpiece W, the workpiece W is placed between the lower die portion 39 and the upper die portion 41. Then, the punches 43, 44 are raised from below and the punches 46, 48 are lowered from above. As a result, the port sections 231, 232 are formed through punching and the grooves 273 and the communication grooves 27*e*, 27*f* are formed through crushing. Afterwards, surface polishing is performed to complete the valve base plate 27. This decreases the manufacturing cost compared to cutting.

In the compressor configured in the above-described manner, the drive shaft 11 shown in FIG. 1 is rotated to cause the lug plate 13 and the swash plate 17 to rotate synchronously with the drive shaft 11. The pistons 21 thus reciprocate in the corresponding cylinder bores 1*a* by the stroke corresponding to the inclination angle of the swash plate 17. The refrigerant gas in the suction chamber 5*a* is thus drawn into and compressed in the compression chambers 24 and conducted out to the discharge chamber 5*b*. The refrigerant gas compressed by the compressor contains lubricant oil mist. The lubricant oil is directed to the sliding portions in the pistons 21, the shoes 33*a*, 33*b*, and the swash plate 17 to prevent wear in these components.

Meanwhile, the difference between the pressure in each compression chamber 24 and the pressure in the suction chamber 5*a* causes elastic deformation of the corresponding suction reed valve 25*a* at the base portion 254, thus allowing the associated valve portion 255 to open the suction port 23*a*. In this compressor, inertial force acts when each suction reed valve 25*a* closes. The valve portion 255 of the suction reed valve 25*a* receives load caused by the difference between the pressure in the corresponding compression chamber 24 and the suction chamber 5*a* in a compression stroke. Particularly, the load is maximized immediately before each piston 21 reaches the top dead center, which is when the pressure in the compression chamber 24 exceeds the pressure in the discharge chamber 5*b* and excessive compression occurs. Accordingly, even if the distal zone of the valve portion 255 is to move toward the valve base plate 27, the corresponding receiving surface 27*b*, which is formed in the valve base plate 27 and flush with the fixing surface 271, contacts the back side of the valve portion 255 in the distal zone. The distal zone of the valve portion 255 is thus prevented from flexing and sinking deeply into the corresponding recessed groove 273.

Particularly, the sealing surface 27*a* and the receiving surface 27*b* are flush and continuous with each other. Accordingly, the back surface 252 of each valve portion 255 contacts the receiving surface 27*b* following contact between the back surface 252 and the sealing surface 27*a*. As a result, even if the suction reed valves 25*a* have varied arm lengths, each suction reed valve 25*a* desirably receives impact on the valve portion 255. Also, the number of machining steps for the valve base plate 27 is minimized, thus reducing costs.

The compressor includes the support surfaces 27*d*, which are formed in the valve base plate 27 and flush with the fixing surface 271, in addition to the receiving surface 27*b*. At the instant when each suction reed valve 25*a* closes or in the period in which the suction reed valve 25*a* is closed, inertial force or load may cause the middle zone of the valve portion 255 to move toward the valve base plate 27. However, the support surface 27*d* contacts the back surface 252 of the valve portion 255 in the middle zone, thus preventing the middle zone of the valve portion 255 from flexing and sinking deeply into the corresponding suction port 23*a*. This prevents fatigue fracture in the valve portions 255.

The communication grooves 27*e*, 27*f* are formed in the surface of the extended portion 272 facing the valve portions 255. Accordingly, at the instant when each suction reed valve 25*a* of the compressor opens, tight contact force does not easily act on the back surface 252 of the valve portion 255. Instead, the back surface 252 of the valve portion 255 receives the pressure in the suction port 23*a*. This further decreases resistance to suction, thus reducing power loss with increased reliability.

Through the above-described operation, the compressor is allowed to decrease the width of each suction reed valve 25*a* and decrease the suction resistance and, thus decreasing the power loss.

As a result, the compressor further decreases the power loss and improves durability.

Also, the compressor decreases pulsation in suction by preventing a delay in opening of each suction reed valve 25*a*. This promotes silent operation of the compressor. Further, decreased resistance to suction in this compressor reduces vibration force, load on the bearings, and piston side force. This decreases mechanical loss and prevents wear, leading to improved power saving and enhanced reliability.

Second Embodiment

Figure 7:
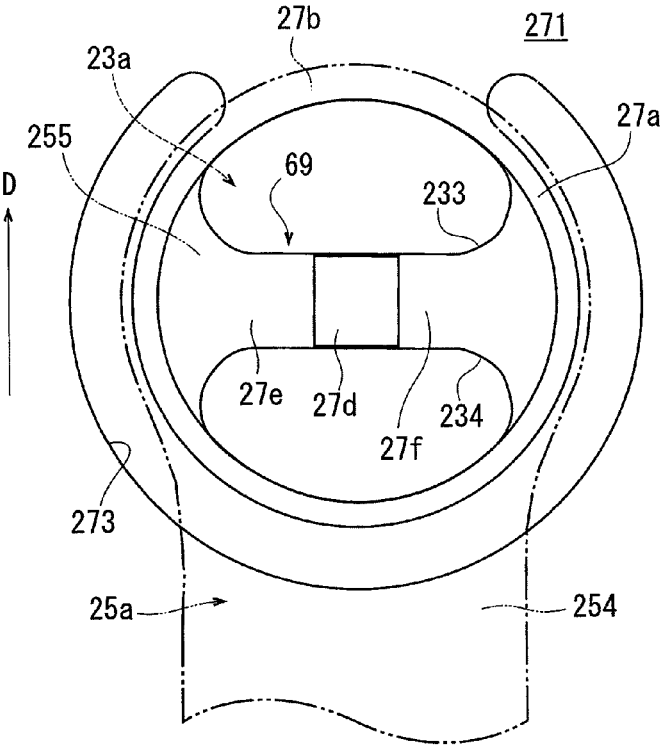
FIG. 7 is an enlarged plan view of a compressor according to a second embodiment, showing a valve base plate.

A compressor according to a second embodiment of the present invention employs an extended portion 69 shown in FIG. 7. The extended portion 69 extends in the valve base plate 27 in the direction perpendicular to the longitudinal direction D to divide the suction port 23*a* into a front section and a rear section in the longitudinal direction D. Specifically, the suction port 23*a* is divided into a port section 233 and a port section 234, each of which has a semi-circular shape, by the extended portion 69. The other components of the second embodiment are configured identical with the corresponding components of the first embodiment.

When the suction reed valve 25*a* rises from the valve base plate 27, the valve portion 255 opens the suction port 23*a* from a distal section of the suction port 23*a* in the longitudinal direction D. At this stage, the compressor of the second embodiment prevents refrigerant gas from being interfered by the extended portion 69, thus facilitating suction of the refrigerant gas into the corresponding compression chamber 24 through the port section 233, which is located in the distal portion in the longitudinal direction D. This configuration decreases resistance to suction and reduces power loss further reliably. The other advantages of the second embodiment are the same as the corresponding advantages of the first embodiment.

Third Embodiment

Figure 8:
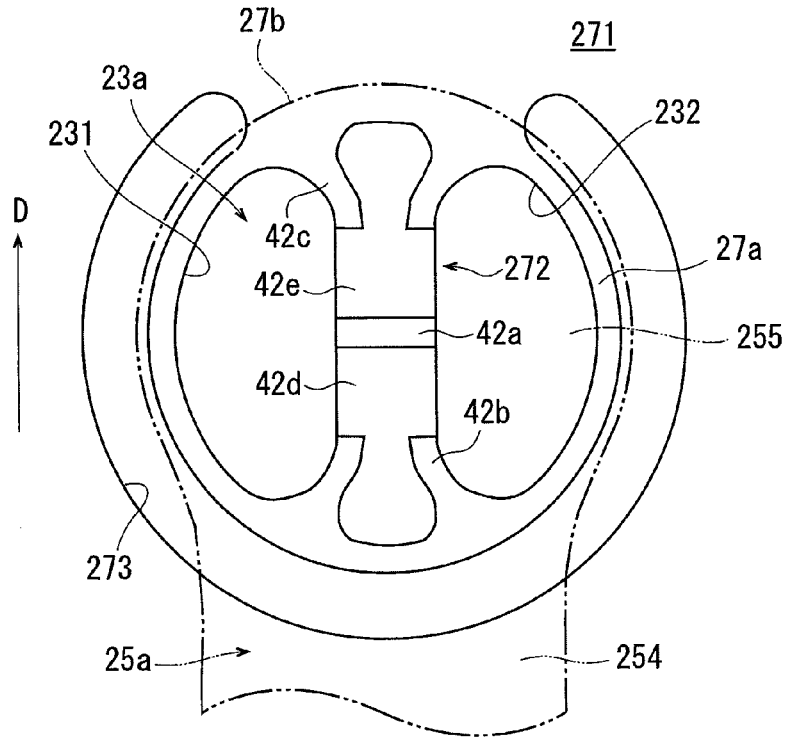
FIG. 8 is an enlarged plan view of a compressor according to a third embodiment, showing a valve base plate and a main portion of a suction reed valve.

As illustrated in FIG. 8, a compressor according to a third embodiment of the present invention includes a middle support surface 42*a*, which is formed in a middle portion of the extended portion 272. The middle support surface 42*a* extends in the direction of the width of the extended portion 272, which is the direction perpendicular to the longitudinal direction D. The middle support surface 42*a* is capable of contacting the back surface 252 of the valve portion 255 in the middle zone of the valve portion 255.

An outer support surface 42*b* and an outer support surface 42*c* are formed at a proximal position and a distal position in the extended portion 272, respectively, in the longitudinal direction D. Each of the outer support surfaces 42*b*, 42*c* substantially has a U shape having an opening facing the center of the suction port 23*a*. The outer support surfaces 42*b*, 42*c* are located on outer sides of the middle support surface 42*a* and flush and continuous with the sealing surface 27*a*.

A communication groove 42*d* is formed between the middle support surface 42*a* and the outer support surface 42*b*. A communication groove 42*e* is arranged between the middle support surface 42*a* and the outer support surface 42*c*. Each of the communication groove 42*d* and the communication groove 42*e* extends into the space surrounded by the corresponding one of the outer support surfaces 42*b*, 42*c*.

Figure 9:
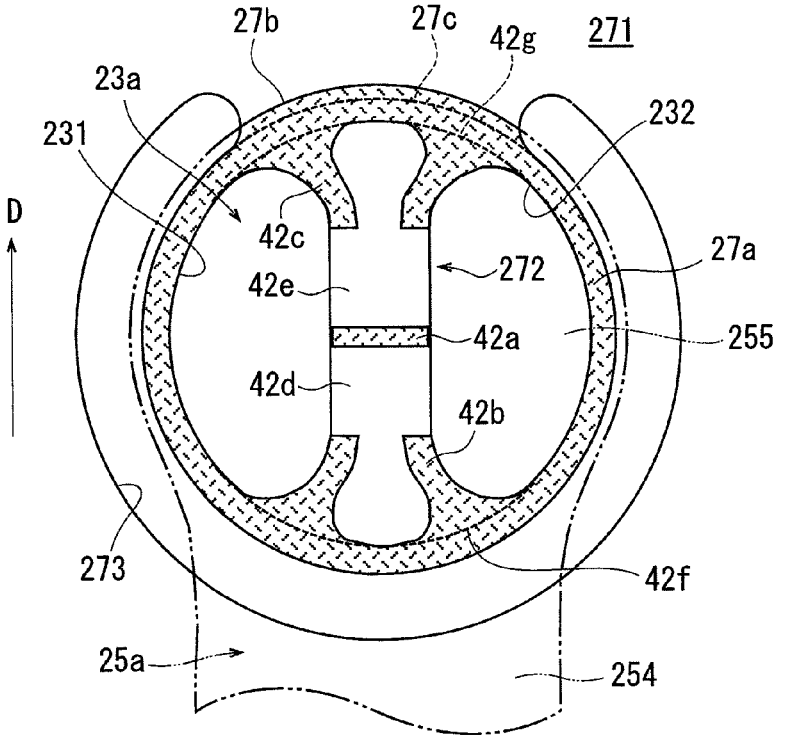
FIG. 9 is an enlarged plan view of a compressor according to a third embodiment, showing the valve base plate.

Referring to FIG. 9, the middle support surface 42*a* and the outer support surfaces 42*b*, 42*c* contact the back surface 252 of the valve portion 255 as indicated by the hatched areas, as in the case of the sealing surface 27*a* and the receiving surface 27*b*. Arcs 42*f*, 42*g*, which are represented by the chain curves in the corresponding hatched area, each indicate the boundary between the sealing surface 27*a* and the corresponding outer support surface 42*b*, 42*c*. The sealing surface 27*a* and the outer support surfaces 42*b*, 42*c* are flush and continuous with one another. The other components of the third embodiment are configured identical with the corresponding components of the first embodiment.

The compressor of the third embodiment supports the middle zone of the valve portion 255 by means of the middle support surface 42*a* and the outer support surfaces 42*b*, 42*c*. The compressor also decreases power loss reliably through the communication grooves 42*d*, 42*e*. The other advantages of the third embodiment are the same as the corresponding advantages of the first embodiment.

Fourth Embodiment

Figure 10:
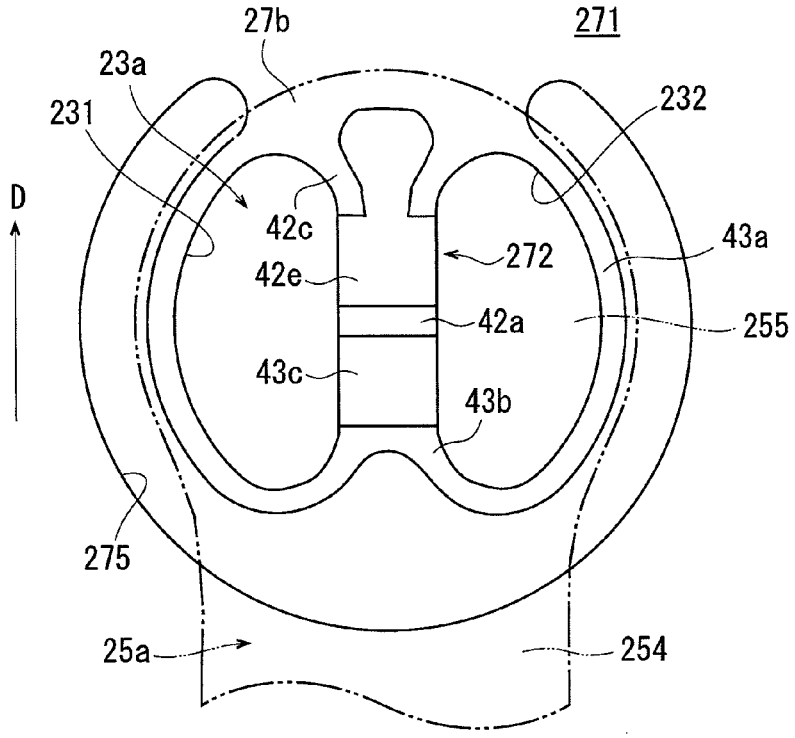
FIG. 10 is an enlarged plan view of a compressor according to a fourth embodiment, showing a valve base plate and a suction reed valve.
Figure 11:
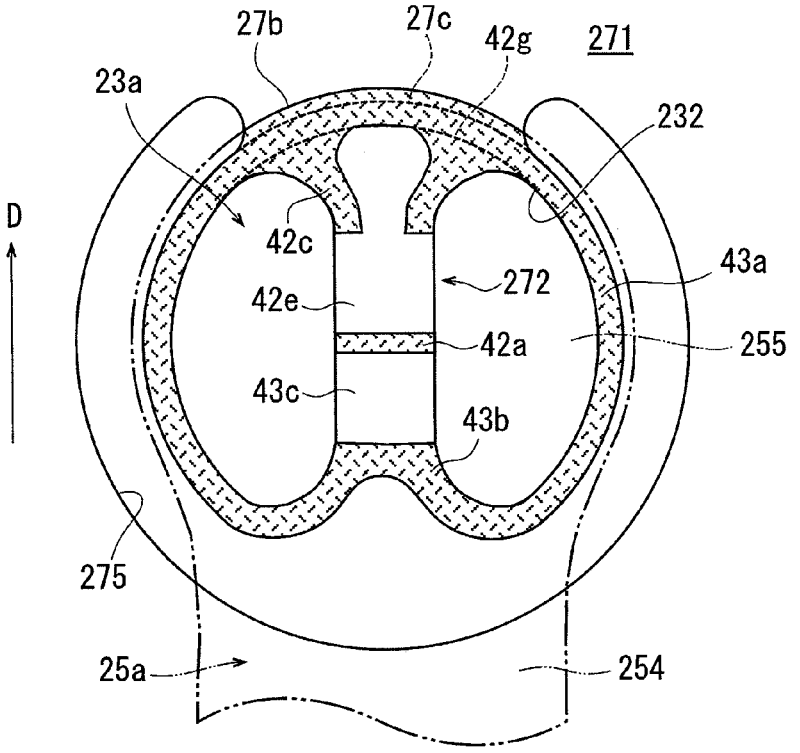
FIG. 11 is an enlarged plan view of the compressor according to the fourth embodiment, showing the valve base plate.

A compressor according to a fourth embodiment of the present invention employs a recessed groove 275, a sealing surface 43*a*, an outer support surface 43*b*, and a communication groove 43*c*, which are shown in FIGS. 10 and 11. Unlike the recessed groove 273 shown in FIGS. 3A to 3C, a proximal portion of the recessed groove 275 in the longitudinal direction D projects distally. As a result, unlike the sealing surface 27*a* shown in FIGS. 3A to 3C, the sealing surface 43*a* has a proximal portion in the longitudinal direction D that projects distally in a manner integral with the outer support surface 43*b*. The communication groove 43*c* does not extend into the space defined by the outer support surface 43*b*. The other components of the fourth embodiment are configured identical with the corresponding components of the third embodiment.

The compressor of the fourth embodiment has the same advantages as the advantages of the third embodiment.

Fifth Embodiment

Figure 12:
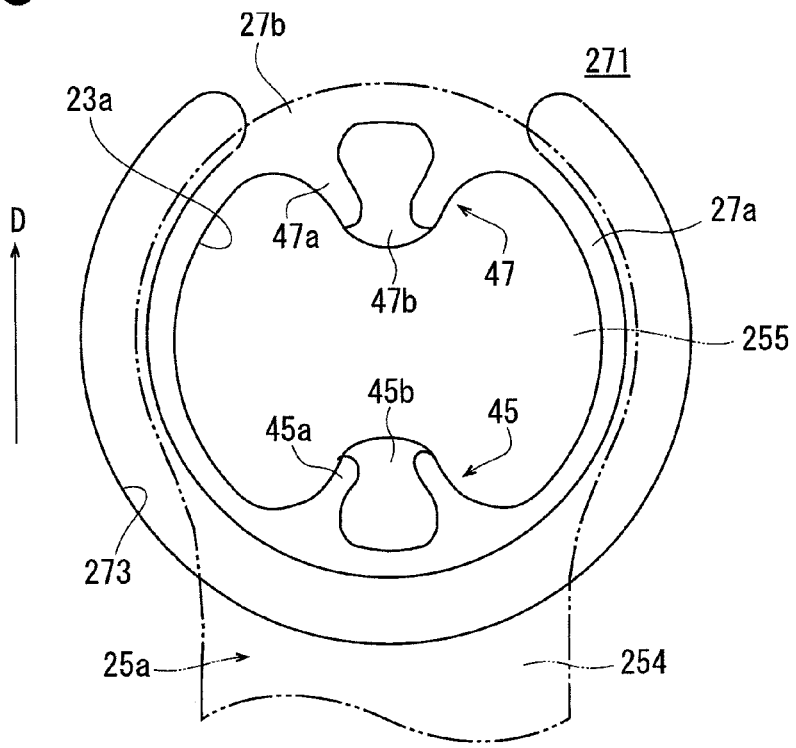
FIG. 12 is an enlarged plan view of a compressor according to a fifth embodiment, showing a valve base plate and a suction reed valve.

As illustrated in FIG. 12, a compressor according to a fifth embodiment of the present invention includes extended portions 45, 47, which are formed in the valve base plate 27. The extended portion 45 extends from a proximal portion in the longitudinal direction D toward the center of the suction port 23*a* by a short distance. The extended portion 47 extends from a distal position in the longitudinal direction D toward the center of the suction port 23*a* by a short distance. The suction port 23*a* has a gourd-like shape without being divided into two sections by the extended portions 45, 47.

An outer support surface 45*a* and an outer support surface 47*a* are formed in the extended portion 45 and the extended portion 47, respectively. Each of the outer support surfaces 45*a*, 47*a* substantially has a U shape having an opening facing the center of the suction port 23*a*. The outer support surfaces 45*a*, 47*a* are flush and continuous with the sealing surface 27*a*.

Figure 13:
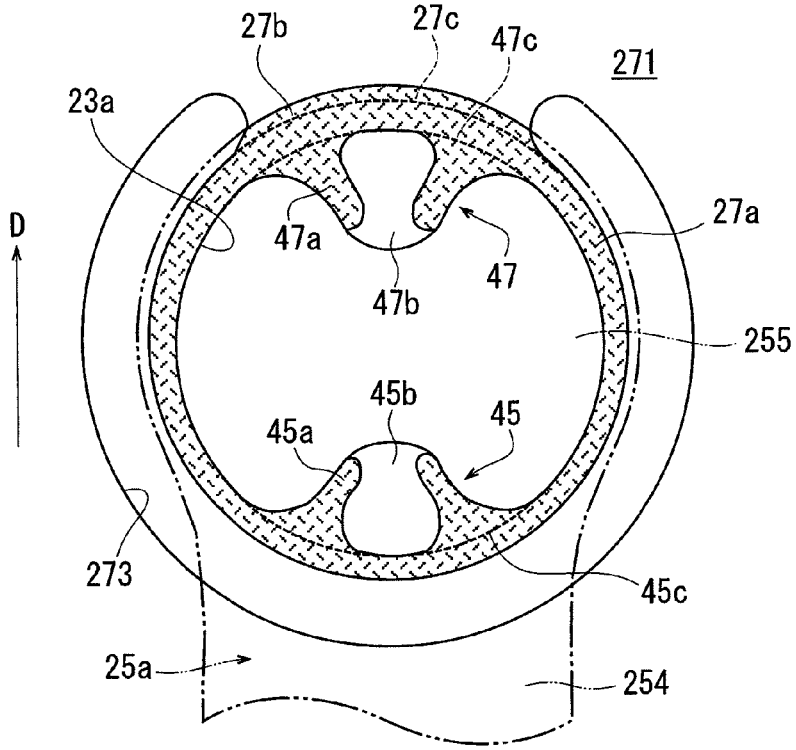
FIG. 13 is an enlarged plan view of a compressor according to the fifth embodiment, showing the valve base plate.

A communication groove 45*b* and a communication groove 47*b* are formed in the outer support surface 45*a* and the outer support surface 47*a*, respectively. Referring to FIG. 13, arcs 45*c*, 47*c*, which are represented by the corresponding chain curves in the hatching area, each represent the boundary between the sealing surface 27*a* and the corresponding outer support surface 45*a*, 47*a*. The other components of the fifth embodiment are configured identical with the corresponding components of the first embodiment.

In the compressor of the fifth embodiment, a central portion of the valve portion 255 is not supported. However, the valve portion 255 is supported by the outer support surfaces 45*a*, 47*a* in the central zone of the valve portion 255. Also, the communication grooves 45*b*, 47*b* reliably decrease power loss. The other advantages of the fifth embodiment are the same as the corresponding advantages of the first embodiment.

Sixth Embodiment

Figure 14:
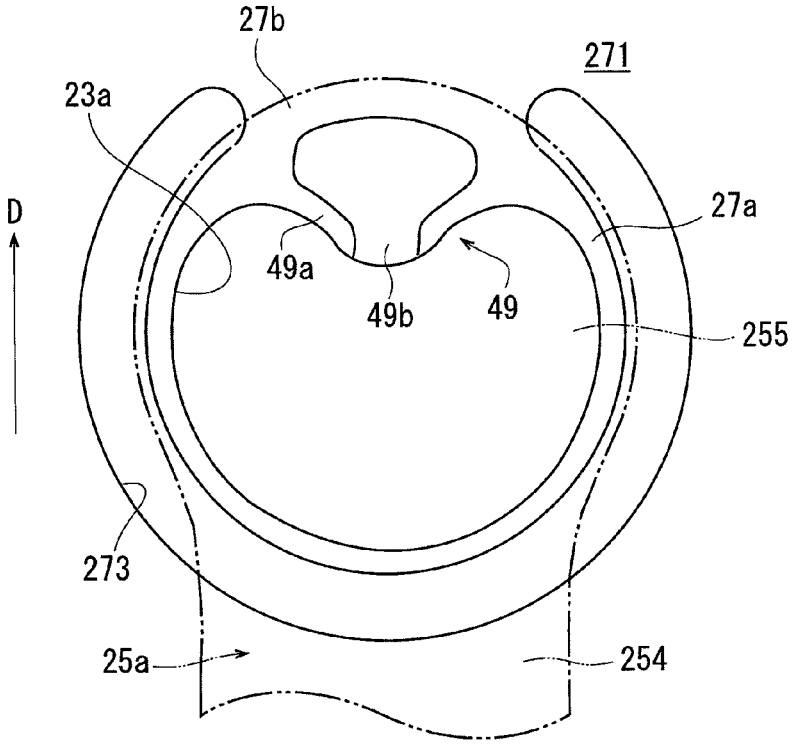
FIG. 14 is an enlarged plan view of a compressor according to a sixth embodiment, showing a valve base plate and a suction reed valve.

A compressor according to a sixth embodiment of the present invention employs an extended portion 49 shown in FIG. 14. The extended portion 49 extends from a distal position in the longitudinal direction D toward the center of the suction port 23*a* by a short distance. The length and the width of the extended portion 49 are slightly greater than the length and the width of the extended portion 47 of the fifth embodiment, respectively. The suction port 23*a* has a curved shape without being divided into two port sections by the extended portion 49.

Figure 15:
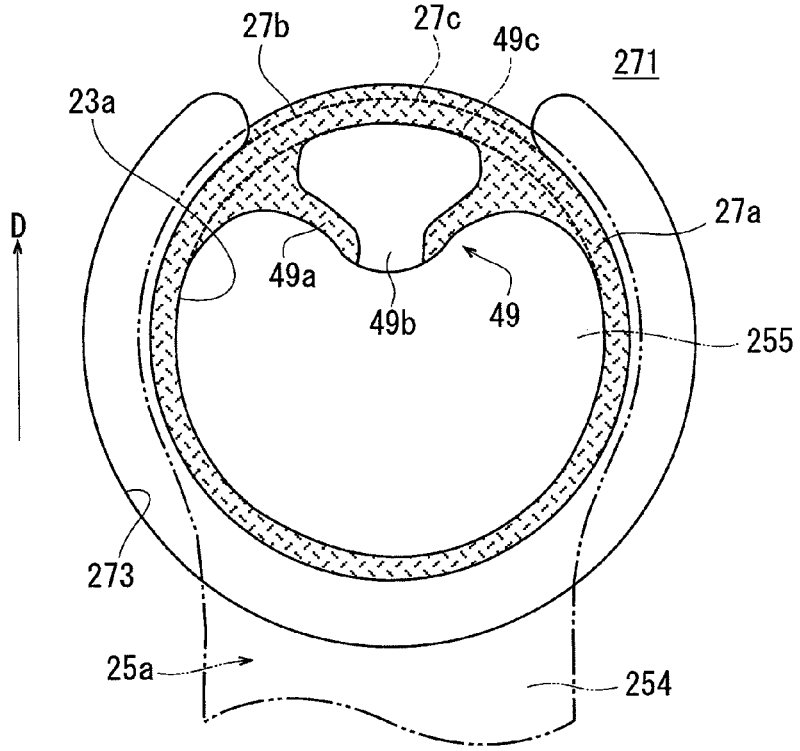
FIG. 15 is an enlarged plan view of a compressor according to the sixth embodiment, showing the valve base plate.

The extended portion 49 includes an outer support surface 49*a*. The outer support surface 49*a* substantially has a U shape having an opening facing the center of the suction port 23*a* and is flush and continuous with the sealing surface 27*a*. In FIG. 15, an arc 49*c*, which is represented by the corresponding chain curve in the hatched area, represents the boundary between the sealing surface 27*a* and the outer support surface 49*a*. A communication groove 49*b* is formed in the space surrounded by the outer support surface 49*a*. The other components of the sixth embodiment are configured identical with the corresponding components of the fifth embodiment.

The compressor of the sixth embodiment also has the same advantages as the advantages of the third embodiment.

Seventh Embodiment

Figure 16:
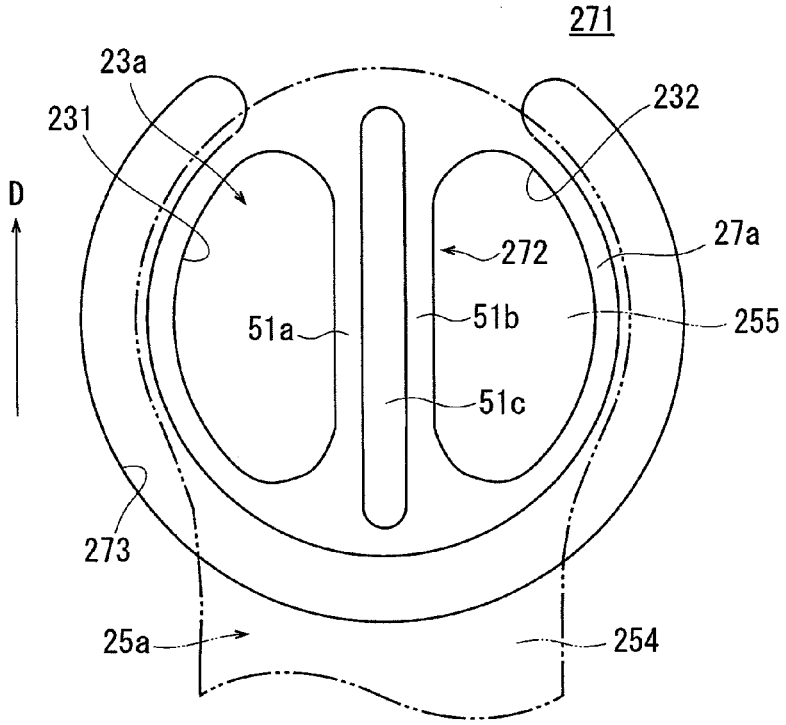
FIG. 16 is an enlarged plan view of a compressor according to a seventh embodiment, showing a valve base plate and a suction reed valve.
Figure 17:
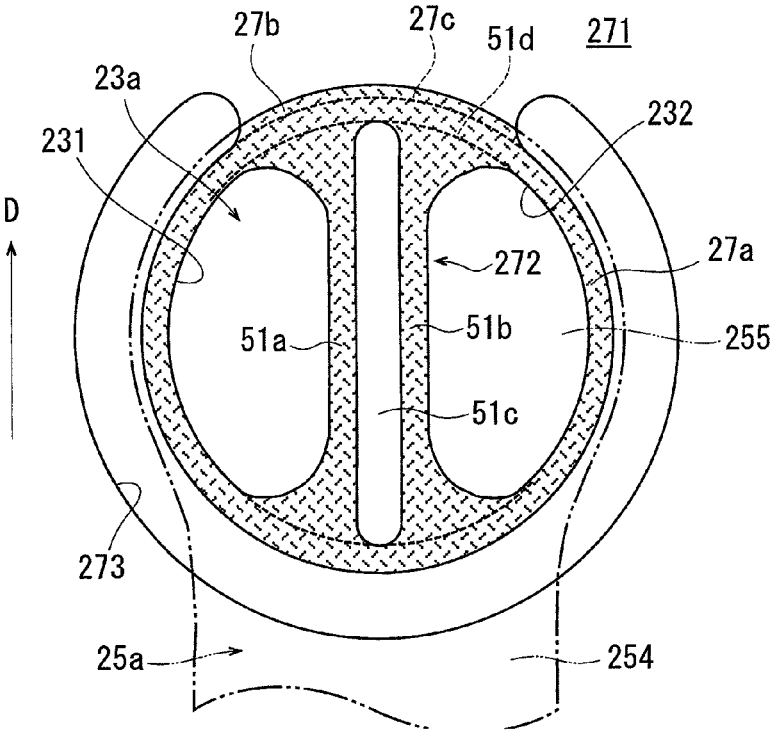
FIG. 17 is an enlarged plan view of the compressor according to the seventh embodiment, showing the valve base plate.

As illustrated in FIG. 16, a compressor according to a seventh embodiment of the present invention has an extended portion 272, which extends in the longitudinal direction D to divide the suction port 23*a* into two port sections. Support surfaces 51*a*, 51*b* are formed on opposite sides of the surface of the extended portion 272 facing the valve portion 255 in the direction of the width of the extended portion 272. The support surfaces 51*a*, 51*b* are flush with the fixing surface 271. With reference to FIG. 17, a circle 51*d*, which is represented by the corresponding chain curve in the hatched area, represents the boundary between the sealing surface 27*a* and the support surfaces 51*a*, 51*b*. The sealing surface 27*a* and the support surfaces 51*a*, 51*b* are flush and continuous with one another.

A recess 51*c* is formed between the support surfaces 51*a*, 51*b*. The recess 51*c* is recessed with respect to the fixing surface 271 and disconnected from the suction port sections 231, 232 by the support surfaces 51*a*, 51*b*. The other components of the seventh embodiment are configured identical with the corresponding components of the third embodiment.

In the compressor of the seventh embodiment, when the suction reed valve 25*a* is closed, the recess 51*c*, which is disconnected from the port sections 231, 232, does not allow the pressure in the suction port 23*a* to act on the back surface 252 of the valve portion 255. However, tight contact force does not easily act on the back surface of the valve portion 255. As a result, the compressor of the seventh embodiment also decreases resistance to suction and reduces power loss further reliably. The other advantages of the seventh embodiment are the same as the advantages of the third embodiment.

Eighth Embodiment

Figure 18:
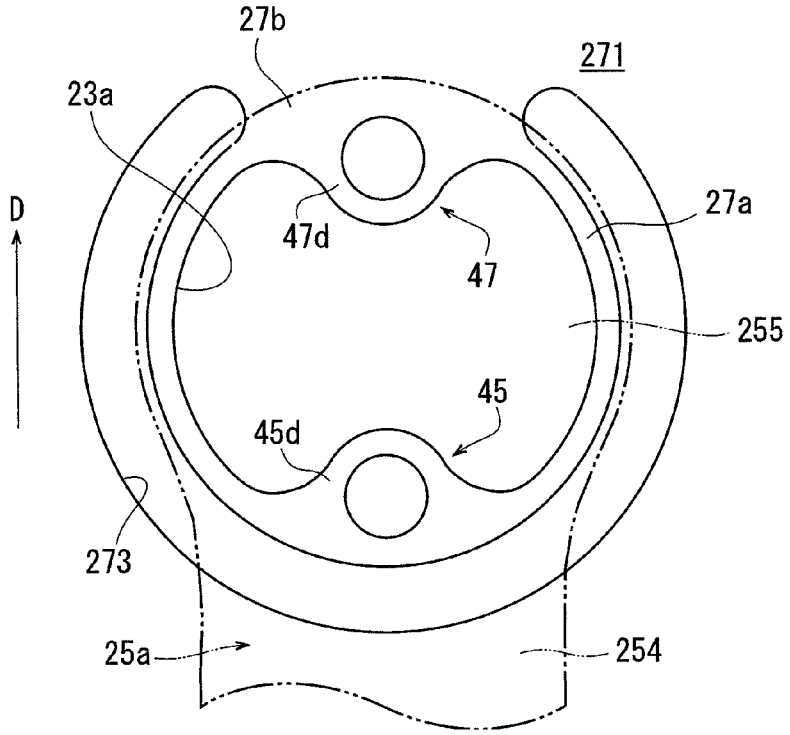
FIG. 18 is an enlarged plan view of a compressor according to an eighth embodiment, showing a valve base plate and a suction reed valve.
Figure 19:
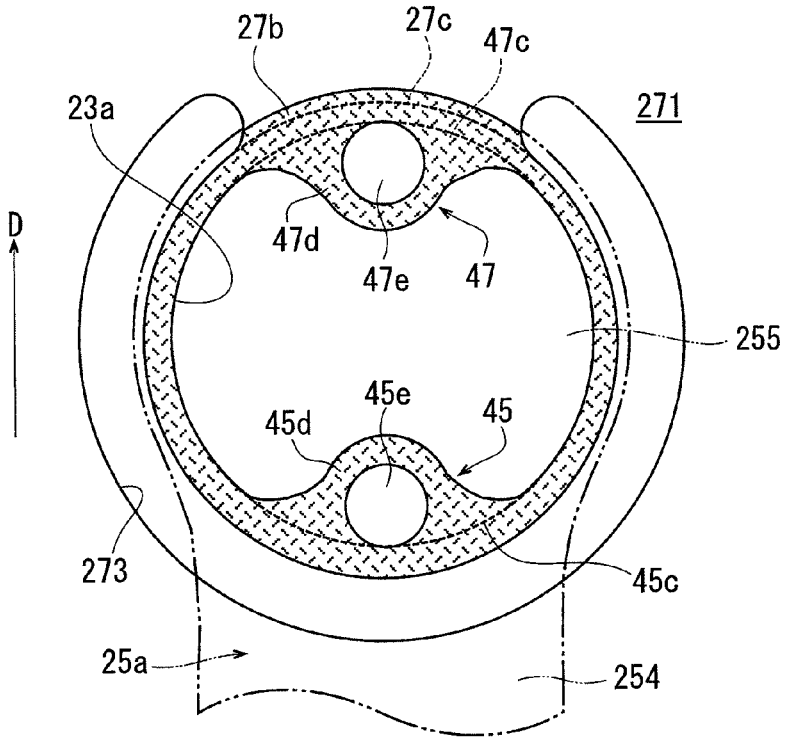
FIG. 19 is an enlarged plan view of the compressor according to the eighth embodiment, showing the valve base plate in the compressor of the eighth embodiment.

As illustrated in FIGS. 18 and 19, a compressor according to an eighth embodiment of the present invention has extended portions 45, 47, neither of which divides the suction port 23*a*. A support surface 45*d* is formed on the surface of the extended portion 45 facing the valve portion 255. A support surface 47*d* is formed on the surface of the extended portion 47 facing the valve portion 255. The support surfaces 45*d*,

47*d* are flush with the fixing surface 271. The sealing surface 27*a* and the support surfaces 45*d*, 47*d* are flush and continuous with one another.

A recess 45*e* and a recess 47*e* are formed in the support surface 45*d* and the support surface 47*d*, respectively. The recesses 45*e*, 47*e* are recessed with respect to the fixing surface 271 and disconnected from the suction port 23*a* by the corresponding support surfaces 45*d*, 47*d*. The other components of the eighth embodiment are configured identical with the corresponding components of the fifth embodiment.

The compressor of the eighth embodiment has the same advantages as the advantages of the third and seventh embodiments.

Ninth Embodiment

Figure 20:
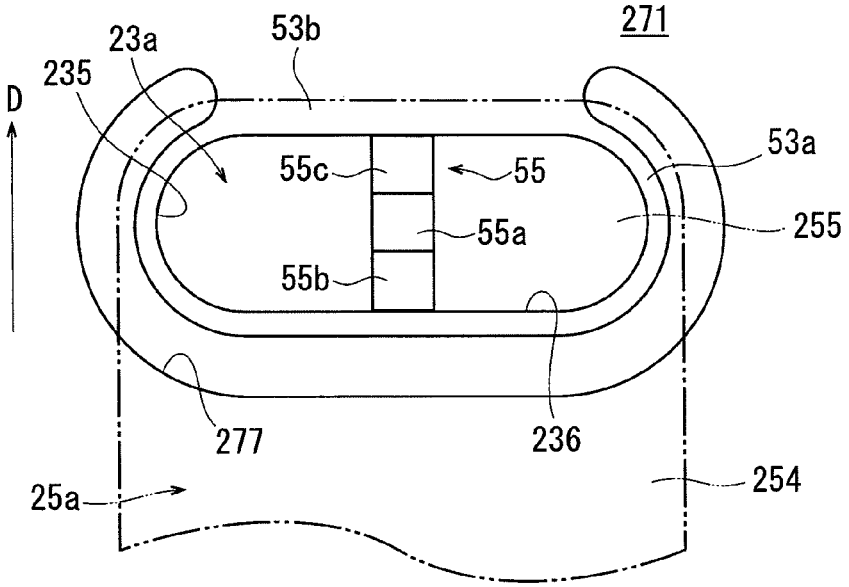
FIG. 20 is an enlarged plan view of a compressor according to a ninth embodiment, showing a valve base plate and a suction reed valve.

A compressor according to a ninth embodiment of the present invention employs a suction port 23*a*, a suction reed valve 25*a*, a recessed groove 277, a sealing surface 53*a*, an extended portion 55, a support surface 55*a*, and communication grooves 55*b*, 55*c*, which are shown in FIG. 20. The suction port 23*a* is an elongated hole extending in the direction perpendicular to the longitudinal direction D. Accordingly, the valve portion 255, the recessed groove 277, and the sealing surface 53*a* of the suction reed valve 25*a* are shaped to match the shape of the suction port 23*a*.

Figure 21:
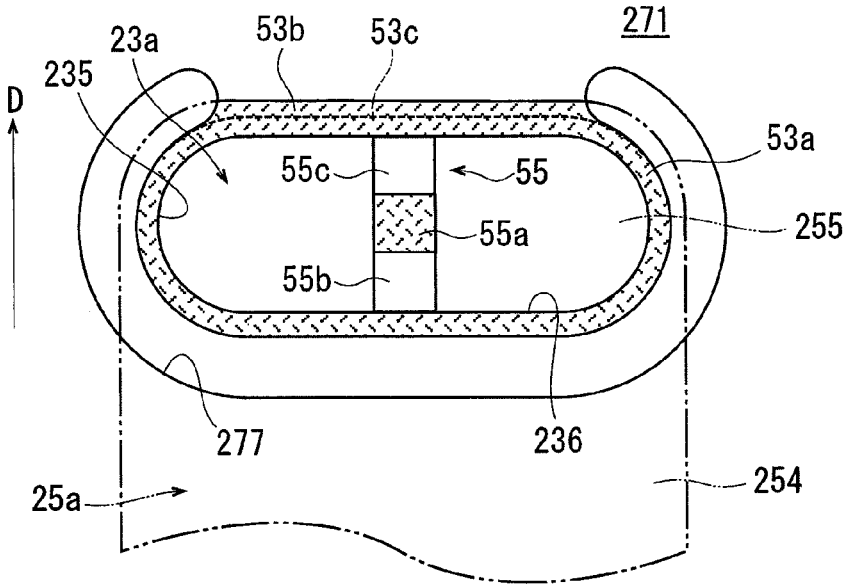
FIG. 21 is an enlarged plan view of the compressor according to the ninth embodiment, showing the valve base plate in the compressor.

In the valve base plate 27, the recessed groove 277 has a C shape matching the shape of the suction port 23*a*. Accordingly, a receiving surface 53*b* extends in a manner elongated in the direction perpendicular to the longitudinal direction D. The support surface 55*a* is flush with the fixing surface 271. Referring to FIG. 21, a line segment 53*c*, which is represented by the chain line in the corresponding hatched area, represents the boundary between the sealing surface 53*a* and the receiving surface 53*b*. The sealing surface 27*a* and the receiving surface 53*b* are flush and continuous with each other.

The valve base plate 27 also includes the extended portion 55, which extends in the longitudinal direction D to divide the suction port 23*a* into two port sections. The support surface 55*a* is formed in the middle of the surface of the extended portion 55 facing the valve portion 255. A communication groove 55*b* and a communication groove 55*c* are formed on a front side and a back side, respectively, of the support surface 55*a* in the extended portion 55. The communication grooves 55*b*, 55*c* are recessed with respect to the fixing surface 271 and allow communication between the port sections 235, 236 when the valve portion 255 is closed. The other components of the ninth embodiment are configured identical with the corresponding components of the first embodiment.

The compressor of the ninth embodiment has the same advantages as the advantages of the first embodiment.

Although the first to ninth embodiments of the present invention have been described, the invention is not restricted to the illustrated embodiments. That is, the invention may be embodied in the following forms without departing from the spirit or scope of the invention.

For example, each suction port 23*a* may have a triangular or rectangular shape as the valve base plate 27 is viewed from above. Any one of the extended portions 272, 69, 45, 47, 49, 55 according to the first to ninth embodiments of the invention may be formed in each suction port 23*a*, which may have an elongated shape or a triangular or rectangular shape. The extending direction of the extended portion 272, 69, 45, 47, 49, 55 is not restricted to the direction toward the center of the suction port 23*a* but may be offset to either peripheral portion of the suction port 23*a* with respect to the center of the suction port 23*a*. Any one of the support surfaces 27*d*, 42*a*, 45*a*, 47*a*, 49*a*, 51*a*, 51*b*, 45*d*, 47*d*, 55*a* of the first to ninth embodiments may be formed in the suction port 23*a*, which may have an elongated shape or a triangular or rectangular shape. It is preferable to shape the valve portion 255 of each suction reed valve 25*a* to match the corresponding one of these shapes of the suction port 23*a*. It is also preferable to shape any one of the grooves 273 to 277 and any one of the sealing surfaces 27*a*, 43*a*, 53*a* to match the corresponding shape of the suction port 23*a*.

Therefore, the present examples and embodiments are to be considered as illustrative and not restrictive and the invention is not to be limited to the details given herein, but may be modified within the scope and equivalence of the appended claims.

The invention claimed is:

1. A compressor comprising:

a valve base plate arranged between a suction chamber and a compression chamber, wherein the valve base plate includes a circular suction port permitting communication between the suction chamber and the compression chamber, the circular suction port having an uninterrupted opening; and a suction reed valve for selectively opening and closing the suction port, wherein the suction reed valve is elastically deformable and has an elongated shape having a distal end, the suction reed valve includes a fixing portion fixed to the valve base plate, a base portion that extends from the fixing portion in a longitudinal direction of the suction reed valve and selectively contacts and separates from the valve base plate, and a valve portion that extends from the base portion longitudinally toward the distal end and selectively opens and closes the suction port, the valve base plate has a fixing surface provided at a side facing the compression chamber, the fixing portion of the suction reed valve being held in contact with and fixed to the fixing surface, the valve portion includes a distal zone including an edge portion at the distal end, and the valve base plate includes:

a sealing surface flush with the fixing surface, the sealing surface being capable of contacting the valve portion in an annular manner around the suction port;

a recessed groove located on an outer side of the sealing surface and recessed with respect to the fixing surface, the recessed groove including a bottom portion, a wall of the recessed groove separating the edge portion of the valve from the bottom portion;

a receiving surface flush with the fixing surface, the receiving surface being capable of contacting the distal zone of the valve portion; and an extended portion that extends from the receiving surface into the suction port toward a center of the suction port without extending to the center of the suction port, wherein the extended portion is continuous with the sealing surface and flush with the fixing surface, and the extended portion includes a support surface that comes into contact with an inner side of the valve portion, and a communication groove arranged in the support surface and that communicates with the suction port when the valve portion closes the suction port.

2. The compressor according to claim 1, wherein the support surface is an outer support surface extending continuously from the sealing surface, and the communication groove is provided in the outer support surface.

3. The compressor according to claim 1, wherein the suction port is formed through punching and the recessed groove and the communication groove are formed through crushing.

4. The compressor according to claim 1, wherein the sealing surface and the receiving surface extend continuously from each other.

5. The compressor according to claim 4, wherein the recessed groove has a C shape as viewed in a plan view, the sealing surface and the receiving surface extending continuously from each other in a zone arranged between opposite ends of the groove.

6. The compressor according to claim 1, wherein the recessed groove includes a first terminal end and a second terminal end located at the distal zone of the valve portion when the suction reed valve is closed, and the receiving surface spans the region between the first and second terminal ends of the groove portion.

7. The compressor according to claim 1, wherein the sealing surface and the receiving surface are integral with each other.

* * * * *